US010027065B1

(12) United States Patent
Lee

(10) Patent No.: US 10,027,065 B1
(45) Date of Patent: Jul. 17, 2018

(54) ELECTRICAL CONNECTOR WITH EDGE PROTECTIVE STRUCTURE AND TONGUE BOARD MODULE THEREOF

(71) Applicant: BELLWETHER ELECTRONIC CORP, Taoyuan (TW)

(72) Inventor: Hsing-Yu Lee, Taoyuan (TW)

(73) Assignee: BELLWETHER ELECTRONIC CORP, Taoyuan (TW)

( * ) Notice: Subject to any disclaimer, the term of this patent is extended or adjusted under 35 U.S.C. 154(b) by 0 days.

(21) Appl. No.: 15/811,756

(22) Filed: Nov. 14, 2017

(30) Foreign Application Priority Data

Jan. 18, 2017 (TW) ..... 106200919 U

(51) Int. Cl.
*H01R 13/6585* (2011.01)
*H01R 13/405* (2006.01)

(52) U.S. Cl.
CPC ..... *H01R 13/6585* (2013.01); *H01R 13/405* (2013.01)

(58) Field of Classification Search
CPC ..... H01R 13/6585; H01R 13/405; H01R 13/6593
USPC ..... 439/607.05, 607.55
See application file for complete search history.

(56) References Cited

U.S. PATENT DOCUMENTS

2015/0171561 A1* 6/2015 Little ..... H01R 24/60 439/607.34
2016/0064870 A1* 3/2016 Yu ..... H01R 24/60 439/607.05
2016/0104975 A1* 4/2016 Guo ..... H01R 13/6585 439/607.05
2016/0118750 A1* 4/2016 Guo ..... H01R 13/6585 439/78
2016/0149349 A1* 5/2016 Kao ..... H01R 13/6586 439/607.05
2016/0149350 A1* 5/2016 Kao ..... H01R 12/724 439/607.05
2016/0181723 A1* 6/2016 Tsai ..... H01R 13/5202 439/587

* cited by examiner

*Primary Examiner* — Tulsidas C Patel
*Assistant Examiner* — Travis Chambers
(74) *Attorney, Agent, or Firm* — Li & Cai Intellectual Property (USA) Office

(57) ABSTRACT

An electrical connector with an edge protective structure is provided, which includes a shielding housing and a tongue board module. The shielding housing has a receiving space for receiving the tongue board module therein. The tongue board module has an insulated retaining member, a protection board and a plurality of terminals. The insulated retaining member has a front edge and two side edges. The insulated retaining member has a slit, which passes through the front edge and extends toward the two side edges. The protection board is disposed in the slit. The terminals include at least two elongated terminals and at least two shortened terminals. The elongated terminals are used to transmit power or to ground. The protection board has a protrusive edge, which is protruded outside the front edge of the insulated retaining member and is exposed to an outside of the two side edges.

10 Claims, 9 Drawing Sheets

ELECTRICAL CONNECTOR WITH EDGE PROTECTIVE STRUCTURE AND TONGUE BOARD MODULE THEREOF

BACKGROUND OF THE INVENTION

1. Field of the Invention

The present disclosure is related to an electrical connector with an edge protective structure, and a tongue board module thereof. In particular, the present disclosure relates to an electrical connector having a tongue board module to connect with another electrical connector for electrical connection, and the tongue board module provides an edge protective structure.

2. Description of Related Art

Electrical connectors have been widely applied to many kinds of electronic products or electrical devices. Because of the tendency of continuous miniaturization of products, size of the electrical connectors is becoming smaller. An electrical connector having a tongue board structure is now commercially available, and the tongue board structure has a plurality of terminals on its surface for electrically connecting a mating electrical connector. The mating electrical connector has a metal housing which usually scratches and damages the tongue board structure during the plugging process. The operating lifespan of the electrical connector, therefore, is shortened.

Therefore, the present disclosure is to solve the problem of how to provide a good protection effect for the tongue board structure so as to prolong the service life of the electrical connector.

SUMMARY OF THE INVENTION

One of the objectives of the present disclosure is to provide a an electrical connector with an edge protective structure and a tongue board module thereof, which have an edge protective structure capable of protecting the tongue board module of the electrical connector of the present disclosure, so as to avoid the stretch damage induced by the another electrical connector during the plugging process.

In order to achieve the above objectives, according to one exemplary embodiment of the present disclosure, an electrical connector with an edge protective structure is provided, which includes a shielding housing and a tongue board module. The shielding housing has a receiving space. The tongue board module is disposed in the receiving space. The tongue board module has an insulated retaining member, a protection board and a plurality of terminals. The insulated retaining member has a front edge and two side edges at two sides of the front edge. The insulated retaining member is formed with a slit, and the slit passes through the front edge and extends toward two of the side edges. The protection board is disposed in the slit of the insulated retaining member. The terminals are disposed on the insulated retaining member. The terminals include at least two elongated terminals and at least two shortened terminals. The at least two shortened terminals are disposed between the at least two elongated terminals. The elongated terminals are used for transmitting power or grounding. The protection board has a protrusive edge. The protrusive edge is protruded outside the front edge of the insulated retaining member, and is exposed outside of the side edges.

In order to achieve the above objectives, according to another exemplary embodiment of the present disclosure, a tongue board module is provided, which includes an insulated retaining member, a protection board and a plurality of terminals. The insulated retaining member has a front edge and two side edges at two sides of the front edge. The insulated retaining member is formed with a slit, and the slit passes through the front edge and extends toward two of the side edges. The protection board is disposed in the slit of the insulated retaining member. The terminals are disposed on the insulated retaining member. The terminals include at least two elongated terminals and at least two shortened terminals. The at least two shortened terminals are disposed between the at least two elongated terminals. The elongated terminals are used for transmitting power or grounding. The protection board has a protrusive edge. The protrusive edge is protruded outside the front edge of the insulated retaining member, and is exposed outside of the side edges.

Thus, the present disclosure has the advantages as follows. The present disclosure provides the electrical connector which has the edge protective structure. The tongue board module has a protection board which is disposed in the middle of the insulated retaining member, for protecting the tongue board module. Thus, the tongue board module of the electrical connector of the present disclosure can avoid the stretch damage induced by a mating electrical connector during the plugging process.

For further understanding of the present disclosure, reference is made to the following detailed description illustrating the embodiments and examples of the present disclosure. The description is for illustrative purpose only and is not intended to limit the scope of the claim.

DETAILED DESCRIPTION OF THE EXEMPLARY EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

First Embodiment

Figure 1:
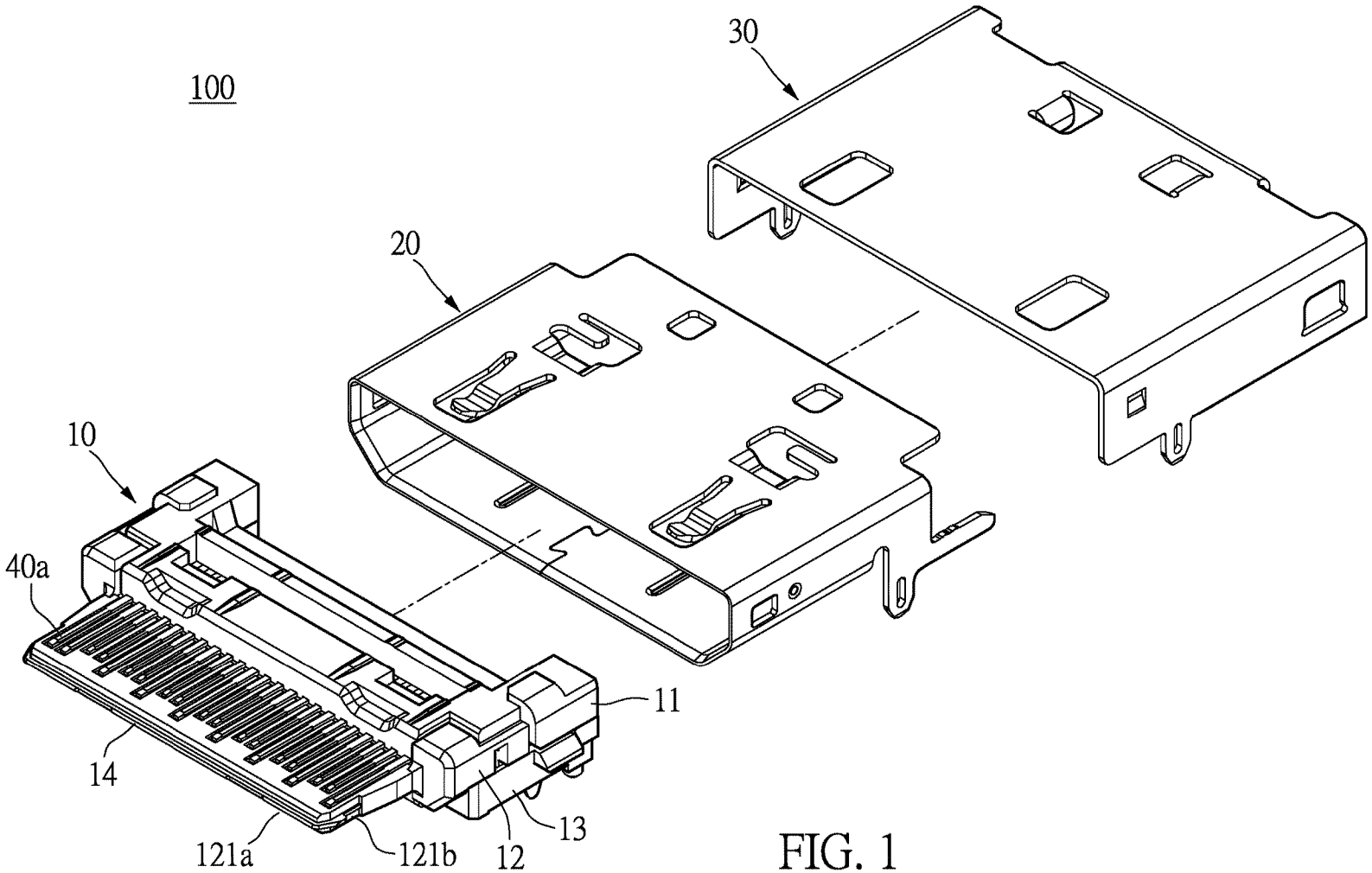
FIG. 1 is a three-dimensional exploded view of an electrical connector with an edge protective structure of the present disclosure.

Reference is made to FIG. 1, which is a three-dimensional exploded view of an electrical connector with an edge protective structure of the present disclosure. The present disclosure provides an electrical connector with an edge protective structure 100, or called as an electrical connector 100, which includes a tongue board module 10, a shielding housing 20, and an outer housing 30. A plurality of terminals 40*a*, 40*b* are disposed on an upper and lower surface of the tongue board module 10, respectively. The tongue board module 10 is received and fixed in the shielding housing 20. The outer housing 30 covers the shielding housing 20.

Figure 2:
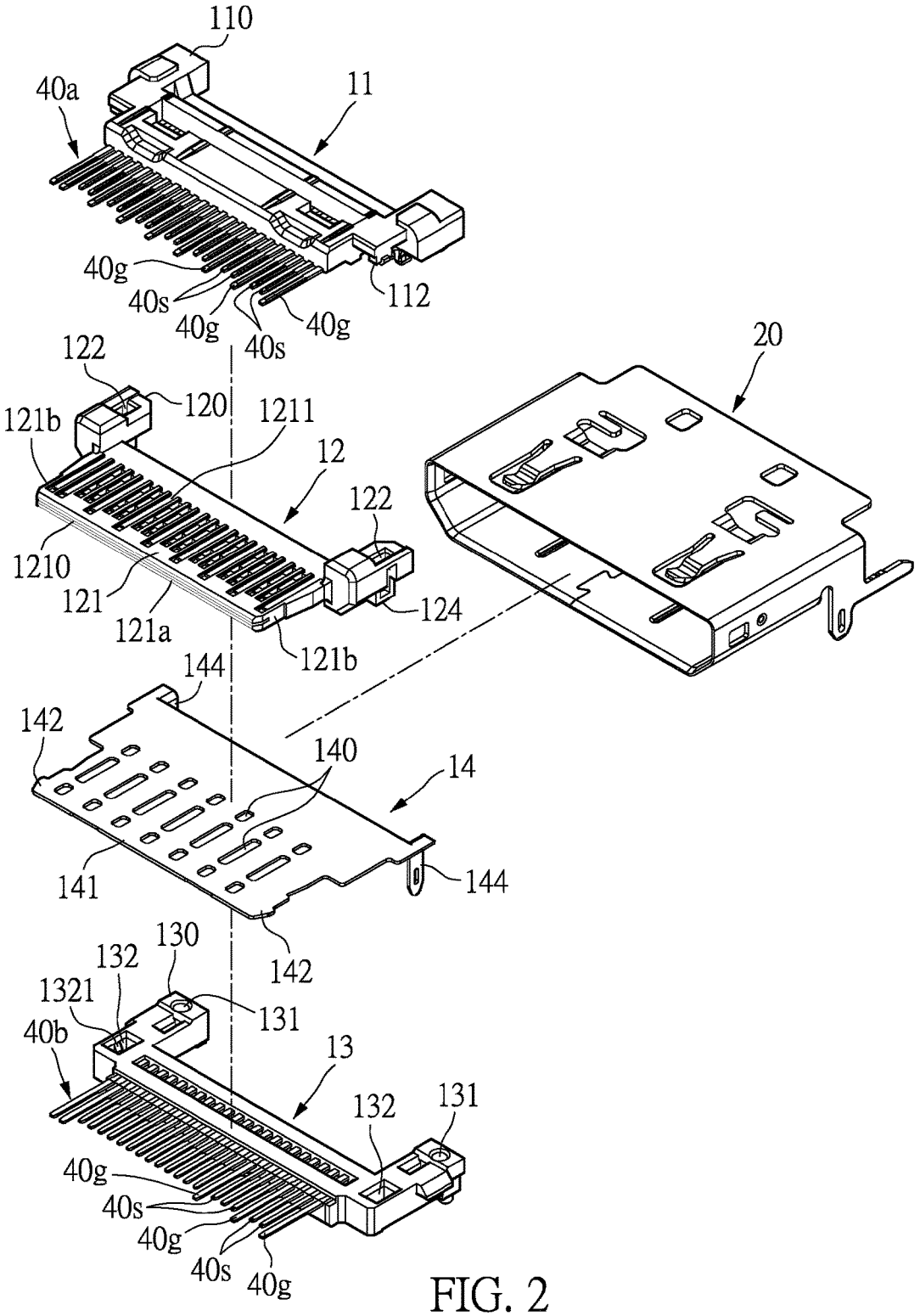
FIG. 2 is another three-dimensional exploded view of an electrical connector with an edge protective structure of the present disclosure.
Figure 3:
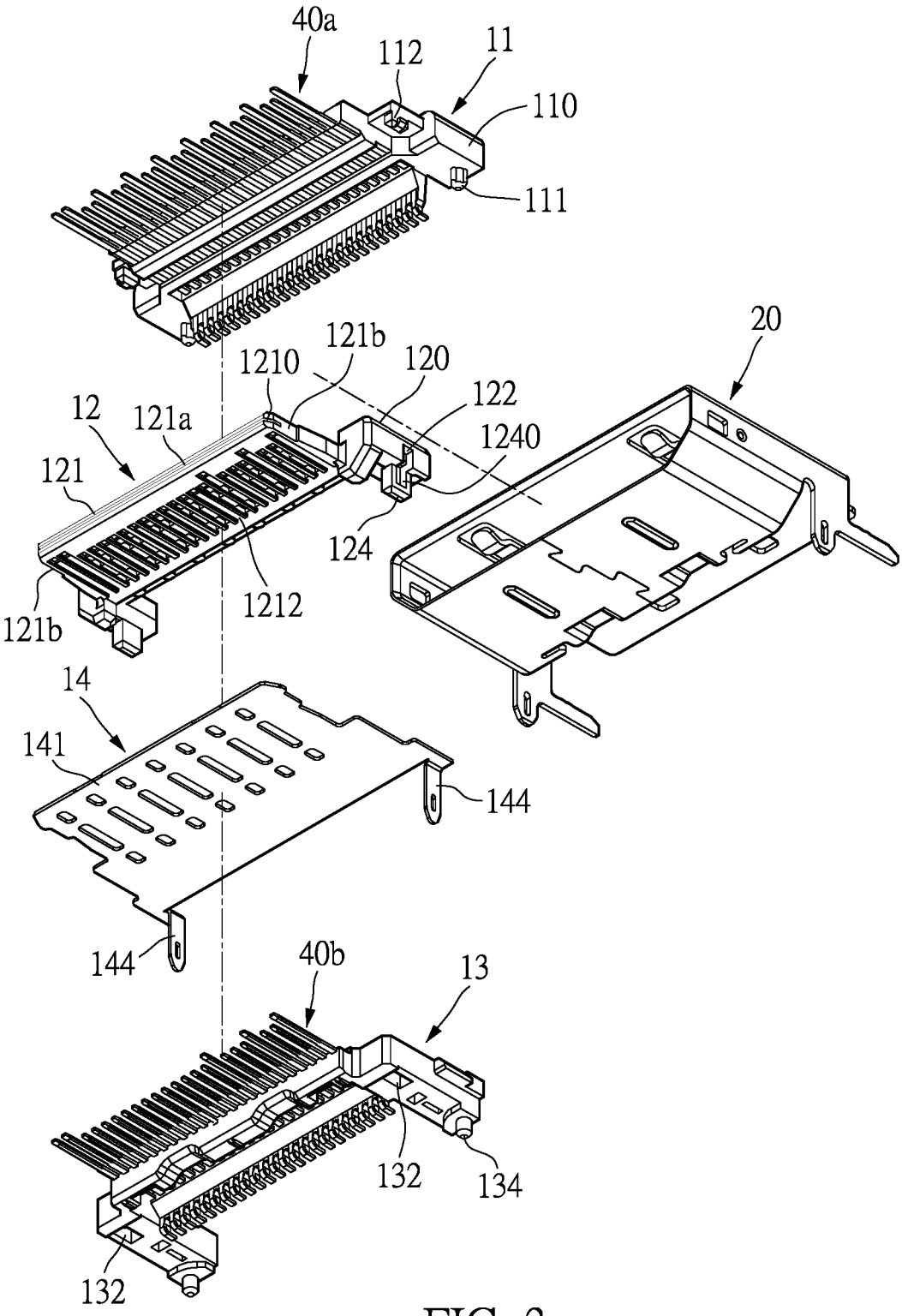
FIG. 3 is still another three-dimensional exploded view of an electrical connector with an edge protective structure of the present disclosure.

Reference is made to FIG. 2 and FIG. 3, which further illustrate three-dimensional exploded views of the tongue board module 10 of the electrical connector 100. The shielding housing 20 has a receiving space formed therein, and the tongue board module 10 is disposed in the receiving space. The tongue board module 10 has an insulated retaining member (refer to the labeled numbers 11, 12, and 13), a protection board 14 and a plurality of terminals 40*a*, 40*b*. The terminals 40*a*, 40*b* are fixed on an upper surface and a lower surface of the insulated retaining member, respectively. The protection board 14 is fixed in the middle of the insulated retaining member. The insulated retaining member can be one integrated piece or be assembled by a plurality of pieces.

The insulated retaining member includes a front edge 121*a* and two side edges 121*b* which are disposed at two sides of the front edge 121*a*. The insulated retaining member has a slit 1210. The slit 1210 passes through the front edge 121*a* and extends toward the two side edges 121*b*. The protection board 14 is clamped in the slit 1210 of the insulated retaining member (refer to the labeled numbers 11, 12, and 13). One characteristic of the present disclosure is that the protection board 14 has a protrusive edge 141. The protrusive edge 141 is protruded outside the front edge 121*a* of the insulated retaining member, and is exposed to an outside of the two side edges 121*b*. In this embodiment, the protection board 14 is arranged in the middle of the insulated retaining member to protect the tongue board module 10 in a clamping manner, so that such a structure can protect the tongue board module 10 of the electrical connector from the stretch damage induced by a mating electrical connector during the plugging process.

In this embodiment, an insert molding method is used to fix the protection board 14 and the terminals 40*a*, 40*b* in the insulated retaining member. The insert molding method, or called as a plastic injection molding method, first disposes an embedded element, that is the protection board 14 and the terminals 40*a*, 40*b*, in a cavity of a mold before filling plastic in the mold, and then fills the plastic in the cavity of the mold, so that the protection board 14 and the terminals 40*a*, 40*b* are integrally embedded and covered by the plastic. The assembly process can be simplified therefore. However, the present disclosure is not limited thereto. The terminals can be assembled and fixed in the tongue board module.

In this embodiment, the protection board 14 is a metallic plate. A rear side of the protection board 14 has two ends from which a leg 144 is protruded. The legs 144 can not only increase the combining strength with the insulated retaining member, but also be soldered to a printed circuit board (not shown) for providing electromagnetic shielding and grounding functions. In addition, the protection board 14 has two sides from which a buckling part 142 is protruded. The two buckling parts 142 are respectively protruded outside the two side edges 121*b* of the insulated retaining member. The protection board 14 is further formed with a plurality of intermediate slots 140. The intermediate slots 140 are arranged in lines along the plugging direction. The terminals 40*a*, 40*b* respectively have a plurality of elongated terminals 40*g* and a plurality of shortened terminals 40*s*. In this embodiment, "elongated" and "shortened" are a relative comparison between the elongated terminals 40*g* and the shortened terminals 40*s*. A length of the elongated terminal 40*g* is longer than a length of the shortened terminal 40*s*. In other words, the grounding terminals or the power terminals are longer than the signal terminals. The elongated terminals 40*g* are used to transmit power or to ground. The shortened terminals 40*s* are used to transmit signals. Positions of the intermediate slots 140 correspond to positions of the elongated terminals 40*g*. Such an arrangement can not only save a material of the protection board 14, but also increase the combining strength of the protection board 14 and the insulated retaining member.

In this embodiment, the insulated retaining member is a three-piece structure. The insulated retaining member has a first retaining element 11, a middle retaining element 12, and a second retaining element 13. The middle retaining element 12 is disposed between the first retaining element 11 and the second retaining element 13. The slit 1210 is formed in the middle retaining element 12. The first retaining element 11 retains the first group of terminals 40*a*. The second retaining element 13 retains the second group of terminals 40*b*. The middle retaining element 12 retains s the protection board 14. The middle retaining element 12 has a first surface which is formed with a plurality of first terminal slots 1211 to receive the first group of terminals 40*a* therein. The middle retaining element 12 has a second surface which is formed with a plurality of second terminal slots 1212 to receive the second group of terminals 40*b* therein.

The first retaining element 11 and a combination way of the middle retaining element 12 and the second retaining element 13 of this embodiment are described as follows. The first retaining element 11 has a first insulated body 110. The first insulated body 110 has an upper surface fixed to a top wall of the shielding housing 20. The middle retaining element 12 has a middle insulated body 120. The middle insulated body 120 is extended forward to form a board-shaped portion 121. The middle insulated body 120 has a pair of engaging holes 122 facing the first retaining element 11, and a pair of wedging legs 124 facing the second retaining element 13. The first retaining element 11 has a buckling bump 112 protruding toward the middle retaining element 12. The buckling bump 112 is protruded from the first insulated body 110. The second retaining element 13 ha a second insulated body 130. The second retaining element 13 has a wedging hole 132 facing the middle retaining element 12. The wedging hole 132 passes through the second insulated body 130. The buckling bump 112 of the first retaining element 11 is wedged in the engaging hole 122 of the middle insulated body 120. The wedging leg 124 of the middle retaining element 12 is wedged in the wedging hole 132 of the second retaining element 13.

In addition, as shown in FIG. 3, the first retaining element 11 further includes a pair of fixing posts 111 which are formed on a bottom surface of the first insulated body 110 and disposed at a rear side of the buckling bump 112. The second retaining element 13 has a pair of fixing holes 131 formed on a top surface of the second insulated body 130.

The fixing holes 131 are formed on a rear side of the wedging hole 132. The fixing posts 111 of the first retaining element 11 are inserted and fixed into the fixing holes 131 of the second retaining element 13.

As shown in FIG. 3, concerning the middle retaining element 12 of this embodiment, positions of the wedging legs 124 correspond to positions of the engaging holes 122. The wedging leg 124 has a lateral groove 1240 facing outward, and the lateral groove 1240 is communicated to the engaging hole 122. As shown in FIG. 2, the second retaining element 13 has an inner bump 1321 formed in the wedging hole 132. The inner bump 1321 is wedged in the lateral groove 1240 of the wedging leg 124.

Figure 4:
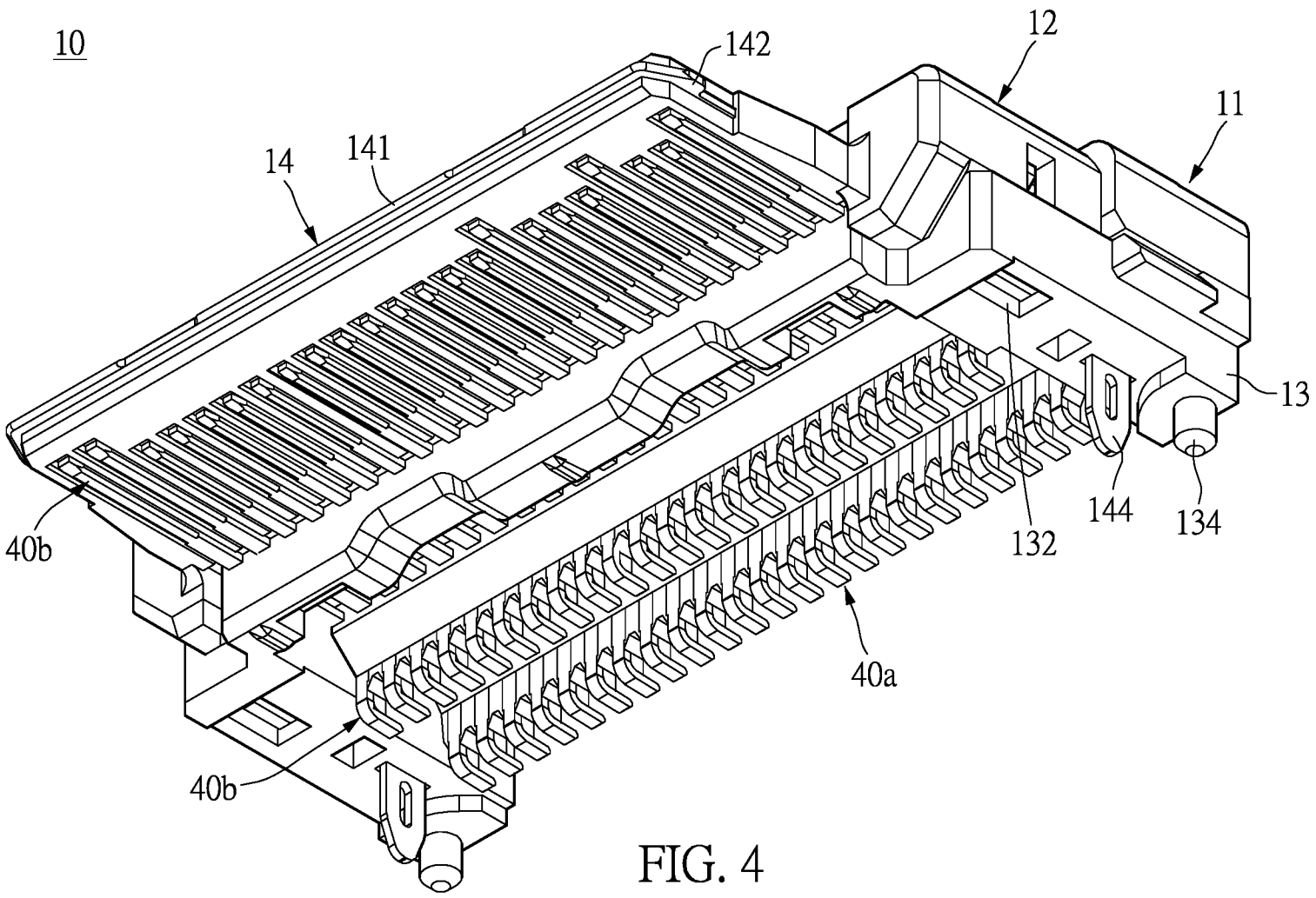
FIG. 4 is a three-dimensional assembly view of a tongue board module of the present disclosure.
Figure 5:
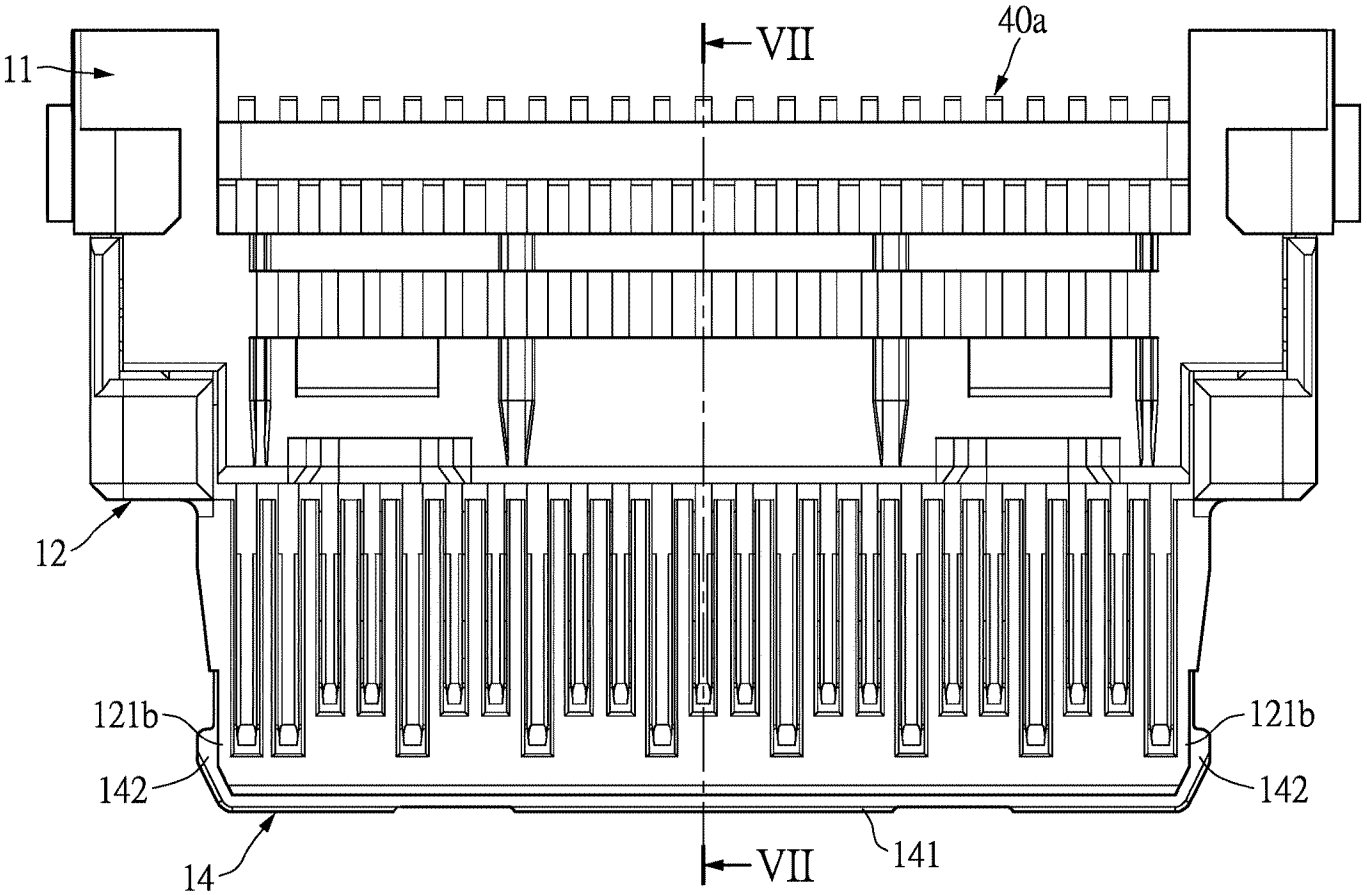
FIG. 5 is a top view of a tongue board module of the present disclosure.
Figure 6:
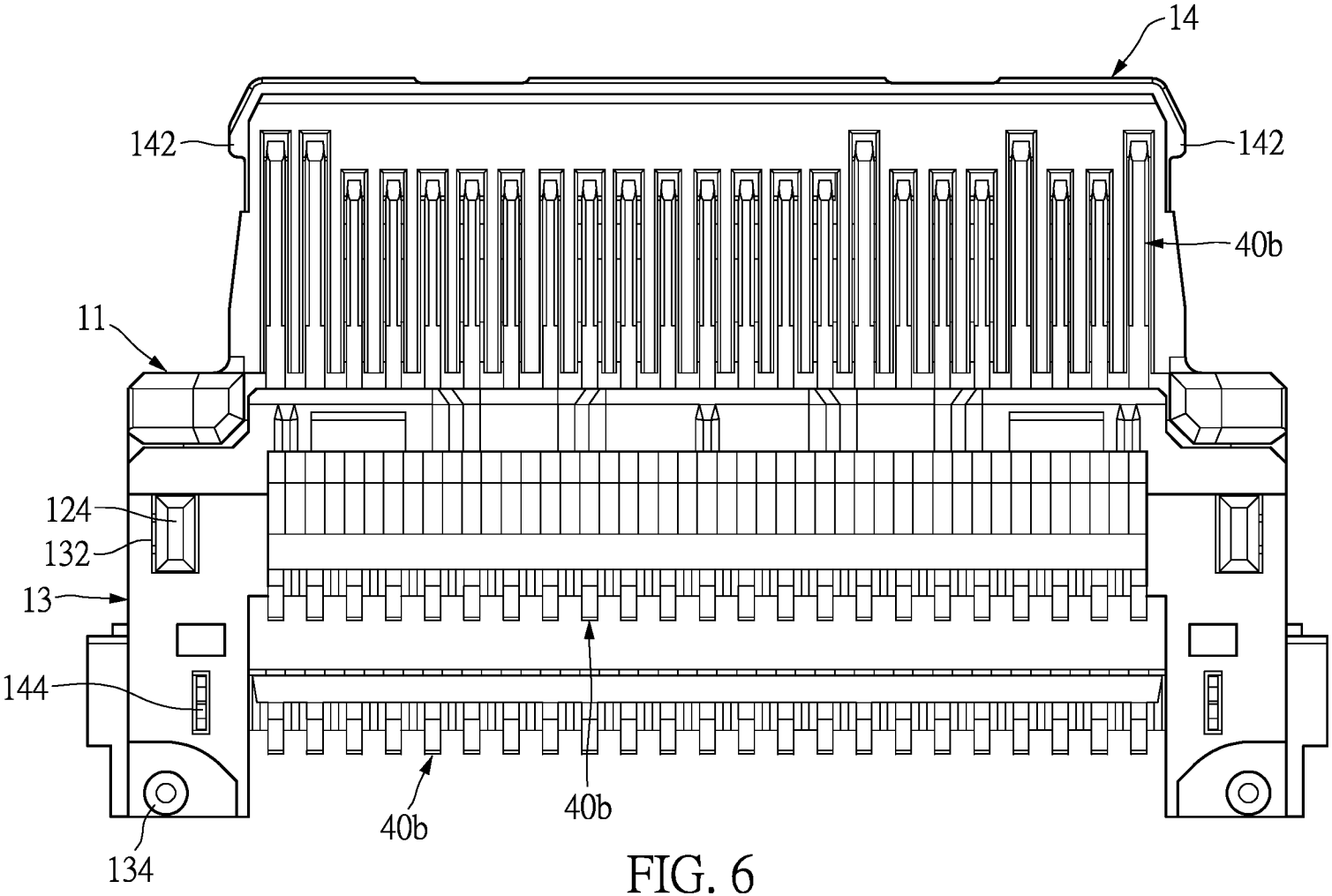
FIG. 6 is a bottom view of a tongue board module of the present disclosure.

As shown in FIG. 4 to FIG. 6, a three-dimensional assembly view, a top view and a bottom view of the tongue board module 10 after being combined according to the present disclosure are demonstrated. FIG. 1 also shows another assembly view of the tongue board module 10. This embodiment has the advantages characterized in that, the middle retaining element 12 is upward assembled with the first retaining element 11 and downward combined with the second retaining element 13, so as to reduce the total height of the tongue board module 10. The middle insulated body 120 of the middle retaining element 12 is clamped between the first insulated body 110 of the first retaining element 11 and the second insulated body 130 of the second retaining element 13. The fixing posts 111 of the first retaining element 11 are used to be inserted and fixed into the second retaining element 13. The combination way is very compact and stable.

As shown in FIG. 4 and FIG. 6, the second insulated body 130 of the second retaining element 13 further has a pair of positioning posts 134 which can be retained on a printed circuit board (not shown). The legs 144 of the protection board 14 are protruded from the second retaining element 13, which can be soldered on the printed circuit board (not shown).

Figure 7:
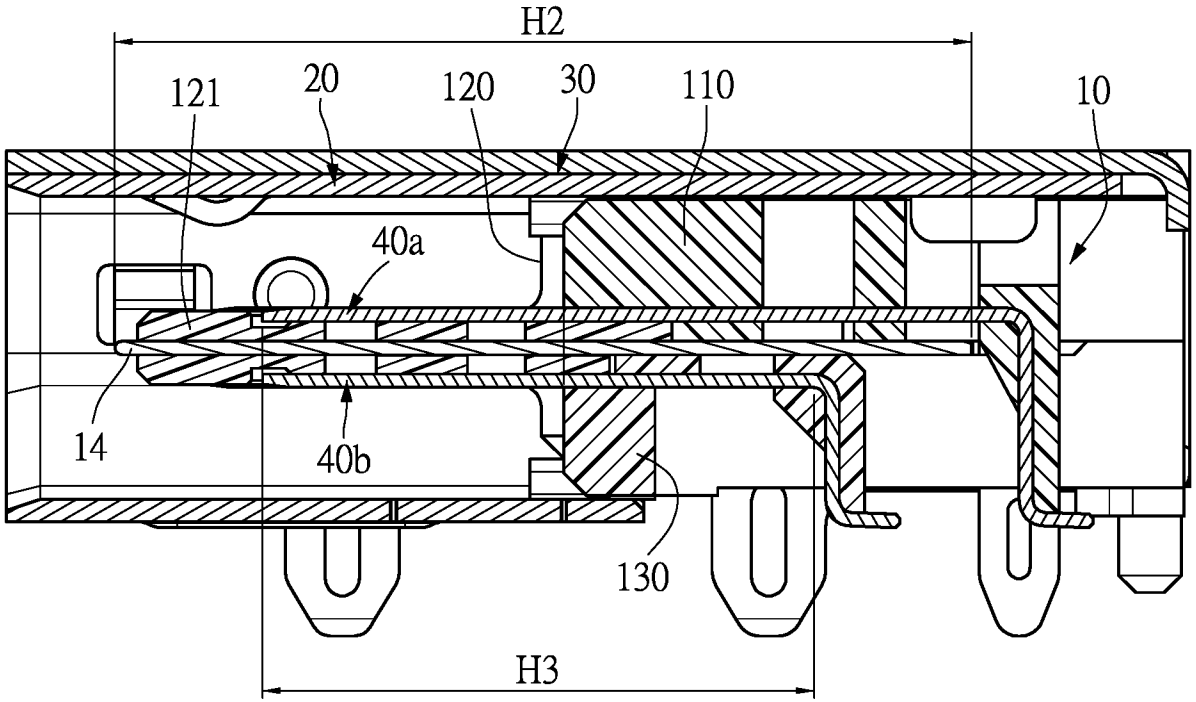
FIG. 7 is a cross-sectional view of an electrical connector with an edge protective structure of the present disclosure.

Reference is made to FIG. 7, which is a cross-sectional view along the line VII-VII in FIG. 5 of the electrical connector with an edge protective structure according to the present disclosure. In this embodiment, the length H2 of the protection board 14 is larger than the length of horizontal section H3 of the second group of terminals 40*b*. The protection board 14 can provide a shielding function for the first group of terminals 40*a* and the second group of terminals 40*b*.

Second Embodiment

Figure 8:
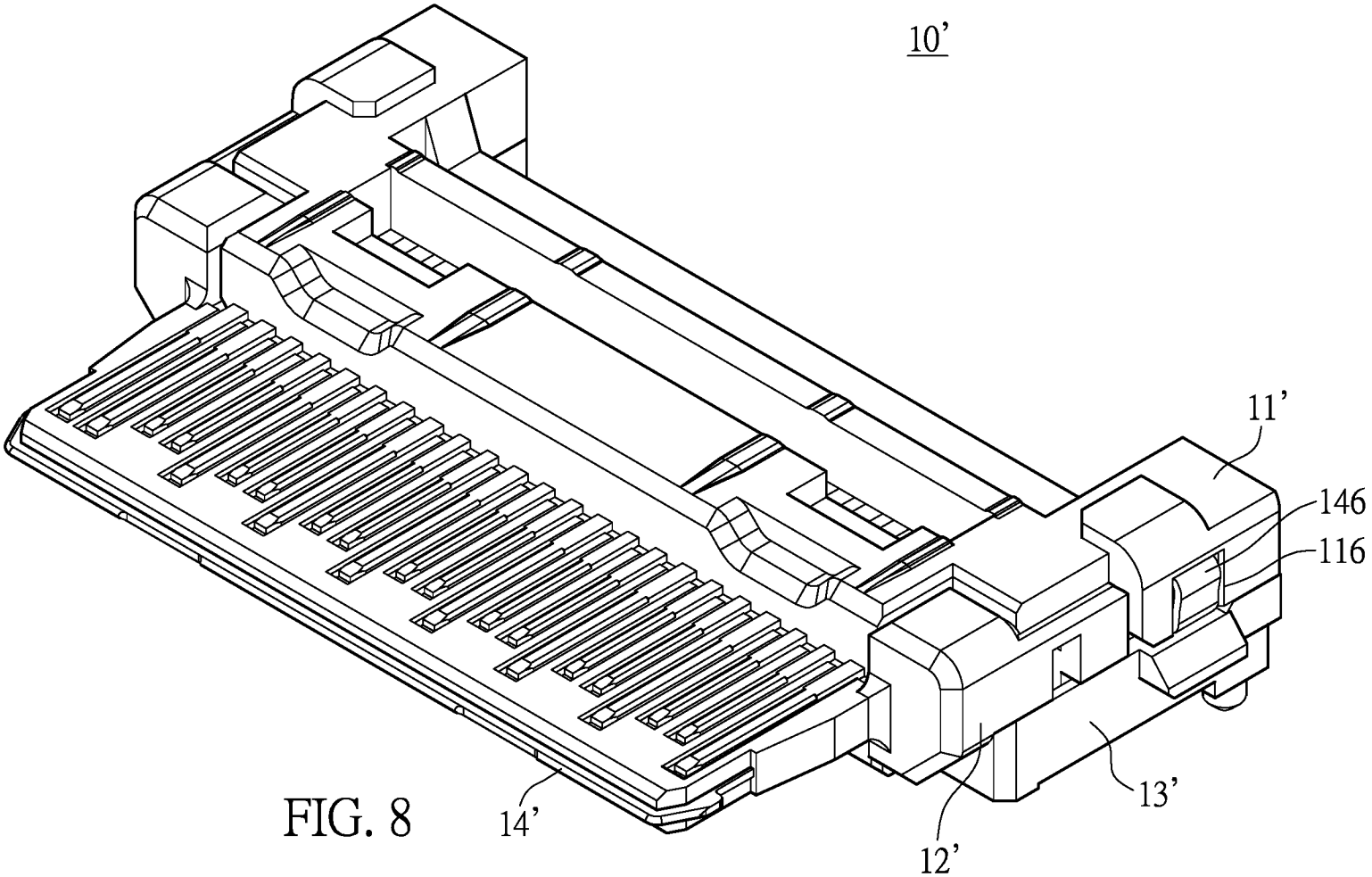
FIG. 8 is a three-dimensional assembly view of a tongue board module of another embodiment of the present disclosure.
Figure 9:
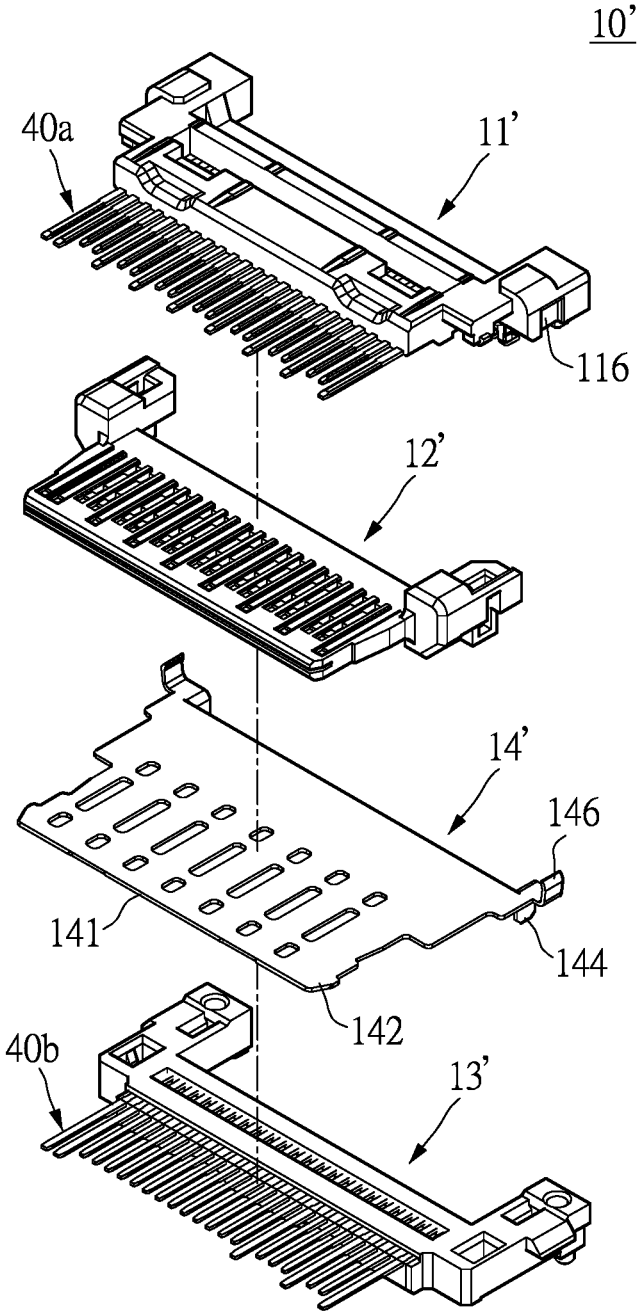
FIG. 9 is another three-dimensional exploded view of a tongue board module of another embodiment of the present disclosure.

Reference is made to FIG. 8 and FIG. 9, which are respectively three-dimensional assembly and exploded views of a tongue board module of the electrical connector according to another embodiment. In this embodiment, a tongue board module 10' is also a three-piece structure, and includes a first retaining element 11', a middle retaining element 12', a second retaining element 13' and a protection board 14' clamped in the middle retaining element 12'. The protection board 14' of this embodiment further has a pair of clamping tabs 146 upward protruded from a rear end thereof. Two outer sides of the first retaining element 11' further have a clamping groove 116 formed thereon, respectively. The clamping tab 146 is fixed in the clamping groove 116. Therefore, the structural strength of the tongue board module 10' is increased more greatly.

To sum up, the present disclosure has the beneficial advantages as follows. The electrical connector of the present disclosure has an edge protective structure, and the tongue board module 10 has the protection board 14 which is positioned in the middle of the insulated retaining member, so as to protect the tongue board module 10. Thus, the tongue board module 10 of the electrical connector can avoid the stretch damage induced by a mating electrical connector during the plugging process. Moreover, the middle retaining element 12 of the tongue board module 10 is clamped between the first retaining element 11 and the second retaining element 13. The rear end of the first retaining element 11 is inserted and fixed into the second retaining element 13. The combination way is very compact and stable.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. An electrical connector with edge protective structure, comprising:

a shielding housing, having a receiving space; and a tongue board module, disposed in the receiving space, the tongue board module including:

an insulated retaining member, having a front edge and two side edges respectively formed at two sides of the front edge, the insulated retaining member having a slit, the slit passing through the front edge and extending toward the two side edges;

a protection board, being a metallic board and disposed in the slit of the insulated retaining member; and a plurality of terminals, disposed on the insulated retaining member, wherein the terminals include at least two elongated terminals and at least two shortened terminals, the at least two shortened terminals disposed between the at least two elongated terminals;

wherein the protection board has a protrusive edge, and the protrusive edge is protruded outside the front edge of the insulated retaining member and exposed outside the two side edges;

wherein the protection board is formed with a plurality of intermediate slots, and positions of the intermediate slots correspond to positions of the elongated terminals.

2. The electrical connector with edge protective structure as claimed in claim 1, wherein the protection board has at least one leg extending therefrom.

3. The electrical connector with edge protective structure as claimed in claim 1, wherein the protection board has two sides from which a buckling part is protruded, and the buckling parts are protruded from the two side edges of the insulated retaining member, respectively.

4. The electrical connector with edge protective structure as claimed in claim 1, wherein the elongated terminal is used to transmit power or to ground.

5. The electrical connector with edge protective structure as claimed in claim 1, wherein the insulated retaining member includes a first retaining element, a second retaining element, and a middle retaining element; wherein the middle retaining element is disposed between the first retaining element and the second retaining element, the slit being formed in the middle retaining element.

6. The electrical connector with edge protective structure as claimed in claim 5, wherein the first retaining element retains a first group of the terminals, and the second retaining element retains a second group of the terminals; wherein the middle retaining element has a first surface formed with a plurality of first terminal slots to receive the first group of the terminals, and the middle retaining element has a second surface formed with a plurality of second terminal slot to receive the second group of the terminals.

7. The electrical connector with edge protective structure as claimed in claim 6, wherein a length of the protection board is longer than a length of a horizontal section of the second group of the terminals.

8. The electrical connector with edge protective structure as claimed in claim 5, wherein the middle retaining element includes a middle insulated body, the middle insulated body includes a pair of engaging holes facing the first retaining element, and a pair of wedging legs facing the second retaining element; wherein the first retaining element has a pair of buckling bumps facing the middle retaining element; wherein the second retaining element has a pair of wedging holes facing the middle retaining element; a pair of the buckling bumps being wedged in the pair of the engaging holes, a pair of the wedging legs being wedged in the pair of the wedging holes.

9. The electrical connector with edge protective structure as claimed in claim 8, wherein positions of the wedging legs correspond to positions of the engaging holes; the wedging leg having a lateral groove, the lateral groove communicating with the engaging hole, the second retaining element having an inner bump formed in the wedging hole, the inner bump being wedged in the lateral groove.

10. A tongue board module of electrical connector, comprising:

an insulated retaining member, having a front edge and two side edges at two sides of the front edge, the insulated retaining member having a slit, the slit passing through the front edge and extending to the two side edges;

a protection board, being a metallic board and disposed in the slit of the insulated retaining member; and a plurality of terminals, assembled on the insulated retaining member;

wherein the protection board has a protrusive edge, the protrusive edge being protruded from the front edge of the insulated retaining member, and exposed from the two side edges; wherein the terminals include at least two elongated terminals and at least two shortened terminals, the at least two shortened terminals disposed between the at least two elongated terminals;

wherein the protection board is formed with a plurality of intermediate slots, and positions of the intermediate slots correspond to positions of the elongated terminals.

* * * * *